United States Patent [19]

Danjyo et al.

[11] 4,279,844

[45] Jul. 21, 1981

[54] METHOD FOR THE REPAIR OF RUNNER FOR MOLTEN METAL

[75] Inventors: Hiroyuki Danjyo, Bizen; Masashi Mori, Okayama, both of Japan

[73] Assignee: Shinagawa Refractories Co., Ltd., Japan

[21] Appl. No.: 12,444

[22] Filed: Feb. 15, 1979

[30] Foreign Application Priority Data

Jun. 23, 1978 [JP] Japan ..... 53-75483

[51] Int. Cl.[3] ..... B28B 1/08

[52] U.S. Cl. ..... 264/30; 264/71

[58] Field of Search ..... 264/30, 71; 266/281

[56] References Cited

FOREIGN PATENT DOCUMENTS

| | | | |
|---|---|---|---|
| 2544436 | 4/1976 | Fed. Rep. of Germany | 266/281 |
| 137939 | 9/1961 | U.S.S.R. | 266/281 |
| 373301 | 8/1973 | U.S.S.R. | 266/281 |
| 406885 | 5/1974 | U.S.S.R. | 266/281 |
| 519476 | 8/1976 | U.S.S.R. | 266/281 |

*Primary Examiner*—Thomas P. Pavelko

*Attorney, Agent, or Firm*—Larson and Taylor

[57] ABSTRACT

A method for the repair of runner lining for molten metal comprising the steps of setting an inner molding former provided with a vibrating mechanism, in a repairing runner for molten metal, filling up under vibration the void space formed between the former and the existing lining, with a runner material containing less water, and curing the filled-up material under heating.

3 Claims, 2 Drawing Figures

METHOD FOR THE REPAIR OF RUNNER FOR MOLTEN METAL

Figure 1:
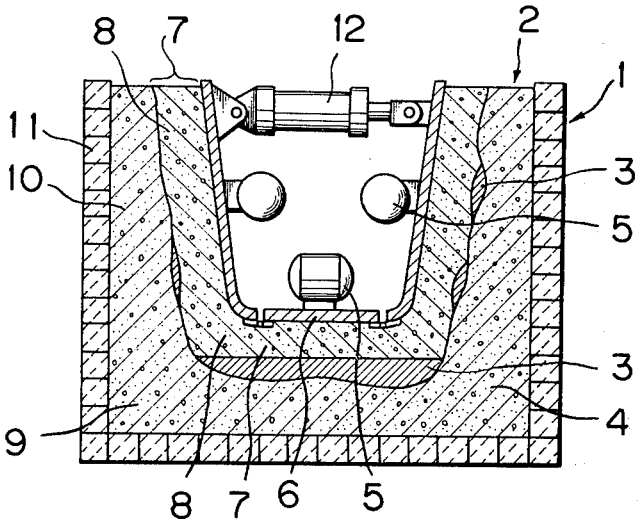

This invention relates to an improvement of method for the repair of lining of a runner for molten metal, such as runner for discharging pig iron from blast furnace.

Conventionally, in the building technic of runners including main runner and iron runner (hereinafter referred to as runner for discharging pig iron) there are a method in which a runner material (moldable material) of 3–4% by weight water content, including a predetermined binder, is stamped into the inside of an outer former with or without the use of an inner former, and a method in which a runner material having a low water content of less than 1.0% by weight and containing a predetermined thermosetting binder is charged into the void space between an outer former and an inner former, and then the runner material is vibrated for full filling, whereby planning labor-saving for construction work and the prolongation of runner life.

However, in any of the two methods the runner for discharging pig iron is liable to be locally damaged, particularly at the bottom portion near the port of discharging pig iron and at the slag line of side wall portion, due to the molten pig iron and slag which are being discharged, thereby impeding the working. This may sometimes cause a danger of accident of pig iron leakage.

It is therefore required, as necessary, to completely remove the pig iron remaining in the runner after the finishing of pig iron discharge, and to repair the runner to its original form so that the internal surface of the runner may be even.

As the repairing technics therefor there are conventionally used (1) an applied method where a gunning method and (2) a method where an inner former of predetermined shape is inserted in the runner for discharging pig iron after use thereof, and there is charged a stamping material for repair between the inner former and the non-damaged portions, said material being stamped by air rammer or the like, or there is poured a castable refractory containing 3–7% by weight water.

However, the method (1) above is non-durable.

Referring to the method (2) above, the working environment is bad in general. In addition, in case there are complicated uneven shapes in the damaged portions the required runner is not durable because the runner material is not tightly filled up to the deepest portions, or in the case of pouring in particular there are brought about various problems such as requiring troublesome drying step, so that there has never been any reliable repairing technic which ensures simple and durable runner.

In view of the disadvantages of the above methods and apparatus the inventors of the invention have made various studies to complete a repair method of lining of improved runner for molten metal, such as runner for discharging pig iron. The essential feature of the invention lies in a lining repair method of runner for molten metal, which is characterized by setting an inner former provided with a vibrating mechanism, within a repairing runner for molten metal, filling under vibration the void space formed between said former and the existing lining, with a runner material which contains less water, and thereafter curing said material under heating. The object of the invention is to improve the working environment and to ensure a quick and trustworthy repair as well as to prolong the like of runner for discharging pig iron.

Figure 2:
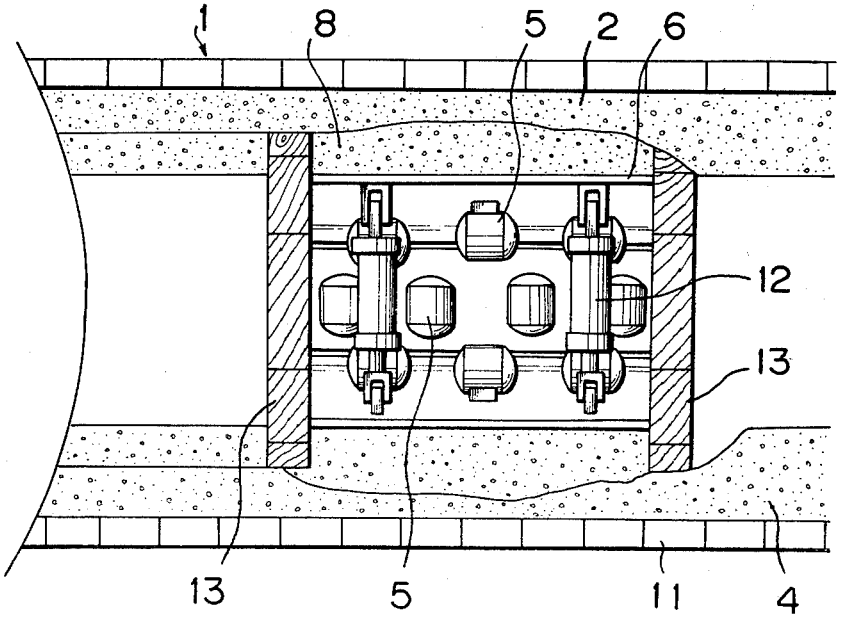

In order that the invention may be more clearly understood one embodiment thereof will be described, by way of example, with reference to the accompanying drawings, in which:

FIG. 1 is transverse schematic view showing a repair outline in the case of carrying out the invention in a runner (main runner) for discharging pig iron from blast furnace; and FIG. 2 is a plan sketch of the same.

According to the present method, as shown in FIG. 1, a pig iron residue 3 is removed, said residue being in an iron pig discharge runner (main runner) wherein a lining has been damaged to certain extent after the pig iron was discharged several times, an inner former 6 rigidly provided with a known vibrating mechanism 5 is inserted into a non-damaged portion 4 of said lining 1, a runner material 8, 8 which filled up a void space 7, 7 between the former 6 and the non-damaged protion 4 and which contains less water, is vibrated, and thereafter the runner material is finally cured under heating by means of a known heating devide (not shown) to complete a repair.

Accordingly, in the first step of the present method, there are removed at the earliest stage after discharging pig iron, a non-solidified pig iron residue 3 remaining at a bottom portion 9 within the pig iron discharge runner 2, and a sticking substance 3 such as metal adhered to a side wall portion 10, and then said inner former 6 is set in a predetermined position so as to form the void space 7, 7.

Referring to the second step, said void space 7, 7 is charged with said runner material 8, 8, and said vibrating mechanism 5 is operated to vibrate the inner former 6 so as to make a predetermined tight filling.

Finally reference is made to the third step. Said runner material is heated, either before or after removing the former 6, for 20 to 60 minutes at a temperature of at the lowest 300° C. by known heating device, thereby curing the material.

That is, the first step is a so-called preliminary step in which the pig iron residue 3 and the sticking substance 3 are removed as much as possible to make a further rigid bonding between said filling runner material 8, 8 and said non-damaged portion 4.

Because of this, it is preferable to solidify, by water sprinkling, the remainder pig iron 3, and slag remaining at the bottom of the runner before complete removal thereof by known digging device (not shown).

Further preferably, a complete removal is carried out event to the deteriorated layer in several millimeter thickness from the surface of said iron pig discharge runner 2 to be repaired so as to expose the non-damaged portion 4, and the non-damaged portion thus exposed is cooled below 200° C. to prolong the runner life.

Said preliminary working varies of course according to time, the number of workers and the like and it may be dispensable in an emergency.

In the case of removing said pig iron residue 3 and said sticking substance 3 of slag, which have been solidified, the conventional repairing method by stamping system has it necessitated to break out even the non-damaged portion 4 additionally so that there may not remain any narrow hollow wherein air rammer cannot enter into, whereby causing a great loss of runner material. According to the present method, however, it is possible to fill up any narrow hollow with said runner material 8, 8 for repair and therefore, it will be sufficient to remove the sticking substance 3 or the like only in the surface of the runner.

Then, the inner former 6 is suspended by crane or the like and inserted into the runner 2 for discharging pig iron. The inner former is then idly mounted to be vertically movable, by an anchoring member (not shown) fixed to the outer former or the like, so as to form said void space 7, 7 between the non-damaged portion 4 and the inner former 6. The second step follows. A prescribed amount of said runner material 8 is charged into the void space 7 from the side face of the inner former 6 by using a small-size chute or the like (not shown), the vibrating mechanism 5 is operated to make the tightest filling of said runner material 8, and the bottom 9 is reinstated to its original form.

Next, the runner material 8 for repair is charged into the void space 7 between the inner former and the side wall portion 10 by the same means to the tightest filling similarly.

In this case it is allowed to charge several different kinds of runner materials 8 in suitable layers and to vibrate them for filling simultaneously.

As referred to below, it is proper to give vibrations of 0.1 mm–2.00 mm amplitude for 3–10 minutes by means of said vibrating mechanism 5 consisting of general vibrator having a revolving spindle and the like, but it is also capable of using electromagnetic type one.

Time less than 3 minutes will not perform sufficient filling, and with the time more than 10 minutes it is not preferable because the inner former 6 may further vibrate the repairing runner material 8, 8 which has already been charged and which is in the most tightly filled state, to transmit the vibrations to the non-damaged portion 4, causing sometimes cracks thereto.

It is likewise possible to press the side panel of the inner former 6 outwardly by expanding a cylinder 12, so as to acuate both the outward pressure and the vibrating power of said inner former, or to give pressure vibration from the upper side with a separately prepared small-size vibrator (now shown) for the improvement of the filling tightness of the upper portion of said side wall portion 10.

In any case, as shown in FIG. 2, sealing ought to be made by square lumber 13, wedge and the like, in order that the filling runner material 8, 8 may not escape from the space between the non-damaged portion 4 and the inner former 6 during the filling-up under vibration.

According to the invention it will not be restricted in any way to the procedures described in said second step, and said procedures may be dispensable, as necessary. Instead, the following procedures may be taken following the first step: A prescribed amount of runner material 8 for repair is charged in the bottom portion 9 by small-size chute or backet, the upper surface of said material is levelled, said inner former 6 is idly placed thereupon as described above, and said material is charged in a predetermined thickness under vibration to repair the side wall portion 10 as described above.

Finally, in the third step there is carried out a curing under heating. Generally, the former is removed immediately after the filling-up under vibration and the runner material filled is heated by town gas burner, but if necessary the filled-up material can be heated at a predetermined temperature with the former as it is, dried and then cured.

Heating must be effected according to the thickness of the repairing portion. For example, in the case of 200 mm thickness it is preferable to heat at a temperature of higher than 300° C. for 20 to 60 minutes, because with the time less than 20 minutes the filled-up runner material may not be sufficiently cured so that an efficient strength as construction body cannot be produced to extremely lower the durable life of runner.

Heating for more than 60 minutes will not increase so good strength but result only in fruitless use of fuel.

The inner former 6 employed in the present invention is generally of the type in which it is made of iron, its section is of U letter or _/shape forming a runner for discharging pig iron, and it is manufactured in a length (between about 2–3 m) for convenient use. For example, there are an inner former of a fixed type wherein is set a vibrator having therein a revolving weight of 1800 R.P.M., an inner former wherein a cylinder is bridged between the two side panels of variable U-shape. To use the latter will expand both the side panels when molding, and increase the filling tightness of the repairing portion in runner sides thereby further improving the durability of runner.

Further, in the case of the latter inner former, the weight of said inner former 6 and the vibrating power of said vibrator having the revolving weight are adjusted in order that said inner former 6 may vibrate with 0.1–2 mm amplitude by operating the fixed vibrator.

If the amplitude is less than 0.1 mm the runner material 8, 8 may have bad fluidity unabling to repair in sufficient thickness, and if it is more than 2 mm the refractory particles constituting said runner material 8, 8 act reversely so great that filling activity is degraded. The amplitude in the above range is therefore preferable.

Moreover, by the runner material 8, 8 scarcely containing water is meant a general runner material of powdery refractory not containing water in particular except the water content (preferably less than 1.0% by weight) innate to the material, said material having particularly a particle size constitution suitable for formation under vibration and a binder. As shown in Table 1, for example, the runner material consists of a mixture in specific particle size of several kinds selected from among electrofused alumina, sintered alumina, mullite, agalmatolite, chamotte, graphite, metallic silicon, ferrosilicon, silicon nitride and the like and of 1–5% by weight of a powdery thermosetting resin as binder for bestowing an initial strength, said runner material being generally used for runners of discharging pig iron.

If necessary, there can be used a castable refractory material consisting of a refractory material where particle size was adjusted to 25–40% by weight of more than 1.4 mm material and 5–35% by weight of less than 0.7 mm material, a thermosetting binder and water content of less than 1.0%.

TABLE 1

| | Item | Runner material | | | | |
|---|---|---|---|---|---|---|
| | | A | B | C | D | E |
| Chemical components (%) | $Al_2O_3$ | 71 | 76 | 83 | 18 | 57 |
| | $SiO_2$ | 2 | 2 | 1 | 53 | 14 |
| | SiC + C | 20 | 15 | 10 | 22 | 18 |
| | $Si_3N_4$ | — | 3 | — | — | — |
| Particle size (% by weight) | Maximum particle diameter (mm) | 5 | 8 | 30 | 6 | 5 |
| | Less than 0.3 mm | 45 | 45 | 40 | 45 | 40 |

Examples and comparative examples are shown in Table 2.

TABLE 2

| Item | Division | Present Invention Example 1 | Example 2 | Example 3 | Conventional Example Stamping Method |
|---|---|---|---|---|---|
| Repairing Portion | Name | Pig Iron Discharge Runner (Main Runner) | Molten Pig Iron Runner | Steel Discharge Runner in Electric Furnace | Pig Iron Discharge Runner (Main Runner) |
| | Range | Bottom Portion just before Pig Iron Discharge Port and Side Wall Portion, about 3 m | Less than 1 m to 10 m after Skimming | About 2 m | Bottom Portion just before Pig Iron Discharge Port, and Side Wall Portion, about 3 m |
| | Configuration (Transverse Section) | 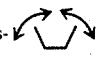 | 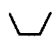 | 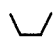 | 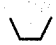 |
| Inner Former | Vibrating Mechanism and Vibrating Time | Variable Type Revolving Spindle Type 15 min. | Fixed Type Revolving Spindle Type 15 min. | Fixed Type Revolving Spindle Type 3 min. | Fixed Type Stamping was made by Air Rammer 15 min. |
| Runner Material | Runner Material Used | Table 1 - A | Table 1 - D | Table 1 - E | Stamp Material of same Chemical Constituents as A |
| | Amount Used (t) | 5 | 5 | 1 | 5 |
| | Repairing Thickness (Average mm) | 200 | 200 | 100 | 200 |
| Man Power for Repair (Person) and Time(min.) | | 6 Persons × 20 min. | 6 Persons × 20 min. | 2 Persons × 20 min. | 10 Persons × 60 min. |
| Heat-Curing | Means | After Removal of Former Town Gas Burner | After Removal of Former Town Gas Burner | After Removal of Former Propane Burner | After Removal of Former Town Gas Burner |
| | Required Calorific Value | 70,000 Kcal | 70,000 Kcal | 10,000 Kcal | 130,000 Kcal |
| | Time (min.) | 30 | 30 | 30 | 120 |
| Durability | Life (day) | 20 | 25 | 110 | 15 |
| | Standard Unit (kg/Hot Melt. t) | 0.3 | 0.1 | 0.3 | 0.5 |

As described above in detail, it is possible through the present invention to repair the damaged portions of a runner for discharging pig iron quickly and accurately and achieve a large labor saving (about 80% decrease) as well as a great energy saving (about 45% decrease) and a prolongation of life (about 1.4 times), resulting in effective and stabilized operation of blast furnace.

The invention has been described above in detail on the basis of Example principally in pig iron discharge runner (main runner) of blast furnace, but the invention can be applied also to the repair of molten pig iron runner, slag runner and tilting runner as well as runner for discharging steel in electric furnace, etc. and the lining of ladle, etc.

What is claimed is:

1. A method for the repair of runner lining for molten metal comprising the steps of setting an inner molding former provided with a vibrating mechanism, in a repairing runner for molten metal, filling up under vibration the void space formed between the former and the existing lining, with a runner material containing less than 1.0 percent by weight of water, and curing the filled-up material under heating.

2. A method for the repair of runner lining for molten metal as described in claim 1 wherein the heating for curing is carried out for over 20 minutes.

3. A method of repairing runner lining for molten metal as described in claim 1 wherein said runner for molten metal is any of slag runner, tilting runner of blast furnace and molten steel runner of electric furnace.

* * * * *